US007371093B1

(12) United States Patent
Johnson

(10) Patent No.: US 7,371,093 B1
(45) Date of Patent: May 13, 2008

(54) ZIF CONNECTION ACCESSORY AND ZIF BROWSER FOR AN ELECTRONIC PROBE

(75) Inventor: Kenneth W Johnson, Colorado Springs, CO (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/555,070

(22) Filed: Oct. 31, 2006

(51) Int. Cl.
*H01R 13/15* (2006.01)

(52) U.S. Cl. ..... 439/260; 439/79; 439/267

(58) Field of Classification Search ..... 439/79, 439/260, 267
See application file for complete search history.

(56) References Cited

U.S. PATENT DOCUMENTS 5,173,058 A * 12/1992 Broeksteeg et al. ..... 439/267
5,549,479 A * 8/1996 Elco et al. ..... 439/67
5,795,171 A * 8/1998 Bernardini ..... 439/260
5,846,097 A * 12/1998 Marian, Jr. ..... 439/289
6,042,410 A * 3/2000 Watanabe ..... 439/269.1
6,089,896 A * 7/2000 Kosmala ..... 439/329
6,371,781 B1 * 4/2002 Jones et al. ..... 439/260
6,533,606 B2 * 3/2003 Yamane ..... 439/495

* cited by examiner

*Primary Examiner*—Truc Nguyen

(57) ABSTRACT

A ZIF connector is mounted on a tiny PCB that carries damping components and flying leads that are connected or soldered to locations of interest on a PCB. There may be one or many of such ZIF connector/connection accessories in any particular test set-up. A ZIF browser is connected to an active probe's tip by short flexible extended transmission lines that lead back to a small interconnect PCB having plated lands that are inserted into the ZIF connector. The ZIF connector is good for just a limited number of uses, but this is in agreement the a customer's usage model for an inexpensive 'disposable' part. Furthermore, the limited lifetime of the ZIF connector/connection accessory is apt to be mitigated in cases where several are in use at one time. The precision microwave connection of the ZIF browser to a potentially delicate and expensive probe tip need not be performed frequently for replacement of the ZIF browser, as the plating on the lands of the interconnect PCB is made thick enough to allow those lands to have a lifetime of 1,500 or more insertions, which is two to three times the amount research suggests is a typical customer expectation.

17 Claims, 4 Drawing Sheets

ZIF CONNECTION ACCESSORY AND ZIF BROWSER FOR AN ELECTRONIC PROBE

REFERENCE TO RELATED APPLICATION

This application is related to the subject matter of an earlier filed US patent application entitled SIGNAL PROBE AND PROBE ASSEMBLY, Ser. No. 11/227,943, filed 15 Sep. 2005 by Michael T. McTigue and assigned to Agilent Technologies, Inc. Because of the similarity in subject matter, and for the sake of both completeness and brevity, SIGNAL PROBE AND PROBE ASSEMBLY is hereby expressly incorporated herein by reference.

INTRODUCTION AND BACKGROUND

Users of certain types of electronic test equipment, such as oscilloscopes and logic analyzers are frequently faced with a dilemma. The connection to the DUT (Device Under Test) or SUT (System Under Test) must be made through a probe of some sort, but there is almost no room to allow it. For example, while one might connect the 50Ω front panel input of a high bandwidth oscilloscope to the 50Ω front panel output of some microwave signal generator using a length of suitable 50Ω transmission line, to get at some signal location on a densely populated PCB (printed circuit board) it is far more likely that a handheld active probe will be needed. These are expensive and delicate assemblies that generally have a 'probe pod' that connects to the front panel of the 'scope, while a cable carries power and a transmission line for the signal from the probe pod to a small handheld probe housing that encloses an amplifier that can drive the transmission line. Generally the amplifier is a differential one with + and − inputs. Sometimes fixed or moveable rigid pins are present for genuine moveable handheld probing at this location and the next. Other times there is no such luxury, as perhaps the PCB cannot be operated on a board extender, and when installed where it belongs there is another board (or a chassis wall) on either side (all on ½ inch centers!). In these cases the user of the 'scope resigns herself to removing the PCB, attaching short 'flying leads' to the probe's tip and then soldering the free ends of those leads to the locations to be 'probed,' and then carefully re-installing the PCB. This works, but gets to be a major aggravation mighty fast if there are many different locations to be observed during the analysis of some complicated situation.

It was in pursuit of a solution to this aggravation that the subject matter of the incorporated SIGNAL PROBE AND PROBE ASSEMBLY was developed. What is disclosed therein is a two part connector assembly, one part of which is coupled to the probe's input, and the other part to the location to be probed. The part that attaches to the probe input has what is known as a ZIF (Zero Insertion Force) connector. A ZIF connector is a (generally female) connector that includes a manually operated release mechanism for expanding the electrical contact elements of individual sockets or electrical receptacles so that they accept corresponding male pins or lands without noticeable (or at least appreciable) force. Once the male portions are fully inserted the action of the release mechanism is reversed (a lever is moved, a tab is slid, or a button released), and the force needed to bring the male and female contacts into good electro-mechanical contact is then re-applied within the female ZIF connector.

ZIF connectors are commonly used in situations where there are many pins (e.g., a large microprocessor that is to be replaceable in the field) and the cost and likelihood of damage using a standard connector is a prohibitive risk. It is not difficult to appreciate this when contemplating a microprocessor or other large IC (Integrated Circuit) that is two or three inches on a side with perhaps four hundred or more pins. The insertion force for any pin/socket with decent wiping action/gripping force means that, for such a large number of pins, a rather robust force would be needed to install the part. When done manually, the slightest misalignment will remain undetected until some pins are bent. Even with good alignment there is still the issue of damage to the PCB or cracking the substrate of the part. Then there is the issue of how to get the old part out. Should it pried out with a screwdriver at one end? Will that crack the socket? Obviating these concerns is what the notion of a ZIF connector is all about.

In the case of SIGNAL PROBE AND PROBE ASSEMBLY the issue is not so much the number of pins, but the mechanical delicateness of the probe tip and the lack of strength in the solder joints used to affix the flying leads to the PCB. (The trace widths on a PCB are often 0.050" or less—not much to solder to.) The idea is to allow a user to attach as many inexpensive male 'connection accessories' with flexible flying leads as needed at any one time to different locations of the PCB. A (female) ZIF connector is hooked up to the probe tip with short flexible extended transmission lines supplied for the purpose. Then the ZIF connector is mated with the appropriate (if more than one) connection accessory and the measurement activity begun. To move the 'scope (or other type of test equipment in use) nothing needs to be unsoldered until all measurement activity is known with confidence to have been concluded.

That is, to perform measurements at other locations the ZIF connector is simply disconnected from one connection accessory and then connected to another. The flexibility of the extended transmission lines and of the flying leads acts as 'mechanical decoupling' between the tethering solder joints and the bulky parts of the active probe (cable from the probe pod and the housing for the amplifier), so that accidental movement of those bulky items will be less likely to break a solder joint between a flying lead and the PCB. A ZIF connector is preferred for this service to, well, 'gorilla-proof' the operation of disconnecting the probe from one connection accessory and then connecting it to another. Because of the high frequency nature of the signals and the apparatus needed to measure them, certain physical dimensions of things allowed to experience the signals are small, perhaps even tiny. (Some oscilloscope browsers will break under just a few ounces of applied pressure!) Bending over in bad light, hands extended beyond the focus of your glasses, off balance and standing on one foot, it is all too easy to accidently apply too much force to a regular connector and break something. So it is ZIF to the rescue, as it were.

As handy as the apparatus of SIGNAL PROBE AND PROBE ASSEMBLY is, we have found room for an improvement. The style of ZIF connector used in SIGNAL PROBE AND PROBE ASSEMBLY is rated for about twenty uses. After that, its ability to form a reliable connection is degraded. Twenty uses is, in many episodes of troubleshooting or analysis, not very many. Particularly so for something apt to be construed as attached "for the duration" to the business end of an expensive active probe for a wide band digital oscilloscope. Furthermore, attaching and detaching things to that probe is not a nonchalant operation with no risk; done carelessly (or if a gorilla is on the loose) it can damage the probe. We need to look at this problem through the other end of the telescope, as it were, and see what might be done.

SIMPLIFIED DESCRIPTION

We keep a similar usage model of a ZIF connector and a connection accessory affixed to a DUT or to some signal traces on a PCB within some SUT. But we relocate the female ZIF connector to being mounted on a tiny PCB that carries isolation and damping components and the flying leads that go to the PCB. Now the ZIF connector is part of the connection accessory, and there may be one or many of such ZIF connector/connection accessories in any particular test set-up, whereas before there was just one ZIF connector per probe. The probe tip still connects to short flexible extended transmission lines that lead now to a small interconnect PCB having plated lands that are inserted into the ZIF connector, and we term that arrangement a ZIF browser. Each ZIF connector is still good for just a limited number of uses, but this is in agreement the typical customer's usage model for an inexpensive 'disposable' part. Furthermore, the limited lifetime of the ZIF connector/connection accessory is apt to be mitigated in cases where several are in use at one time. Unnecessary wear and tear on the precision microwave connectors for the connection of the ZIF browser to the tip of the expensive and delicate probe is avoided, as it need not be performed frequently for replacement of the ZIF browser. To make the ZIF browser robust, the plating on the lands of the interconnect PCB is made thick enough to allow those lands to have a lifetime of 1,500 or more insertions, which is two to three times the amount research suggests is a typical customer expectation. A further advantage to this arrangement is that it is easier to hold the (now larger than before) ZIF connection accessory steady in one hand while maneuvering the (now smaller than before) flexible leads and interconnect PCB of the ZIF browser with the other; the operation is rather like threading a needle by moving the thread instead of the needle.

DETAILED DESCRIPTION

Figure 1:
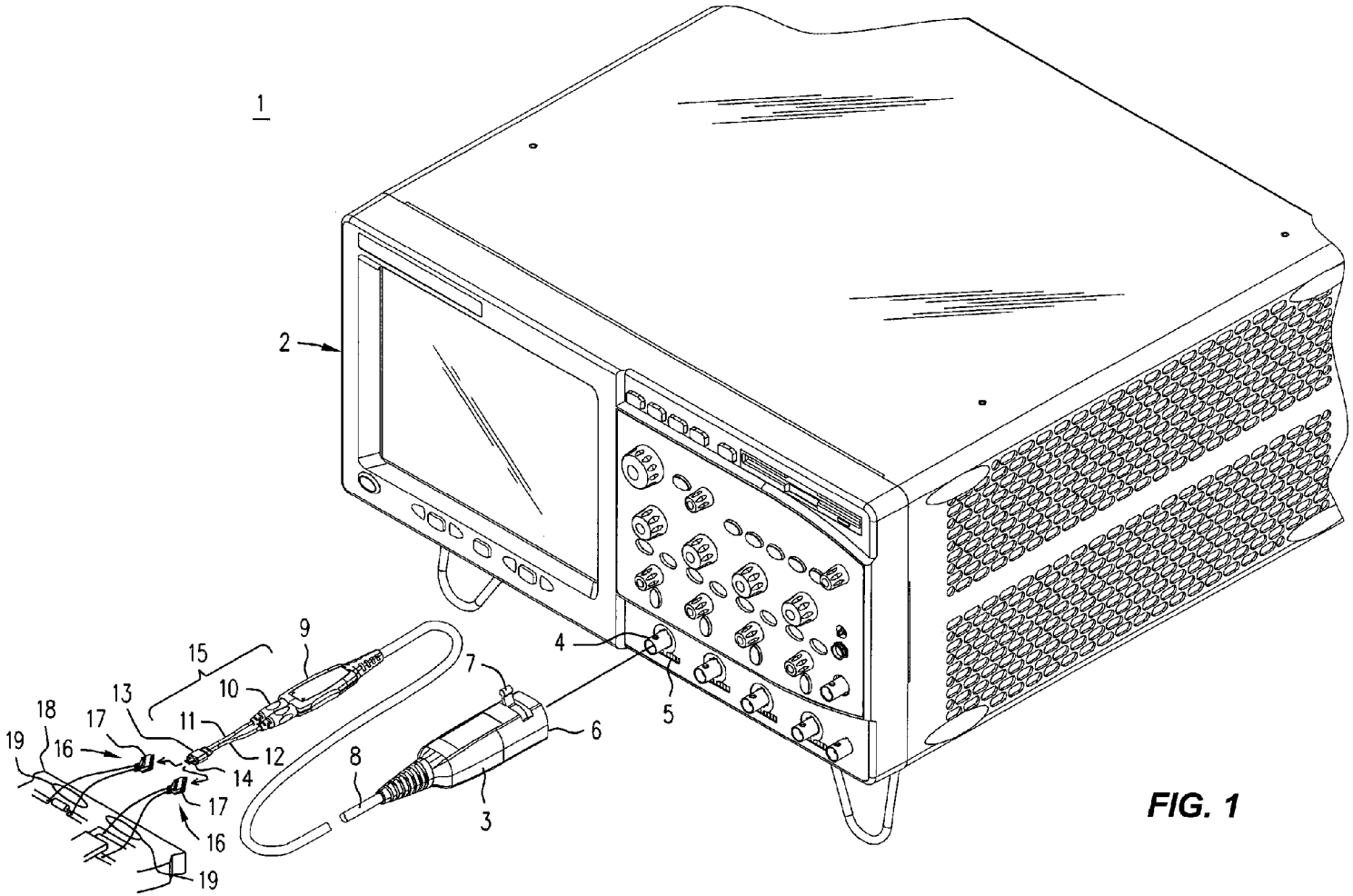
FIG. 1 is a front perspective view of an oscilloscope and attached active probe having a ZIF browser to be mated with one of one or more instances a ZIF connection accessory that is in turn attached some locations on a workpiece to measure a signal of interest.

Refer now to FIG. 1, wherein is shown a front perspective view 1 of an electronic instrument 2, such as a wideband digital oscilloscope, having one or more front panel connectors 4 that each receive a probe pod 3 bearing (in the example) a push-lock BNC connector, say, in support of operation with active probes. In a manner known in the prior art, the probe pod 3 is installed simply by lining it up and then pushing it toward the 'scope. When the probe pod 3 is in place, not only is a BNC connection established to connector 4, a row of spring loaded pins 6 (not visible) on the front panel of the pod assembly engages a row 5 of contacts beneath the connector 4. To remove the push-lock connector the operator pushes on lever or tab 7 with a thumb or a finger, while pulling the assembly away from the 'scope. A main cable 8 carries both power to, and signal information from, a handheld probe housing 9 containing the high frequency replication amplifiers that make the probe an 'active' probe.

(We hasten to point out that the particular probe pod 3 and its probe housing 9 depicted in FIG. 1 represent certain practices that are followed for certain of Agilent Technologies' active probes for wideband oscilloscopes, and are merely an exemplary starting place for the explanation that follows. There is a fair amount of variation in the appearance, internal division of labor and manner of internal operation among the various vendors of active probes: e.g., Tektronix does it differently. No matter, the basic notion of a ZIF browser and its ZIF connection accessory that we are about to illustrate and explain is of interest to most any sort of active probe.)

Figure 2:
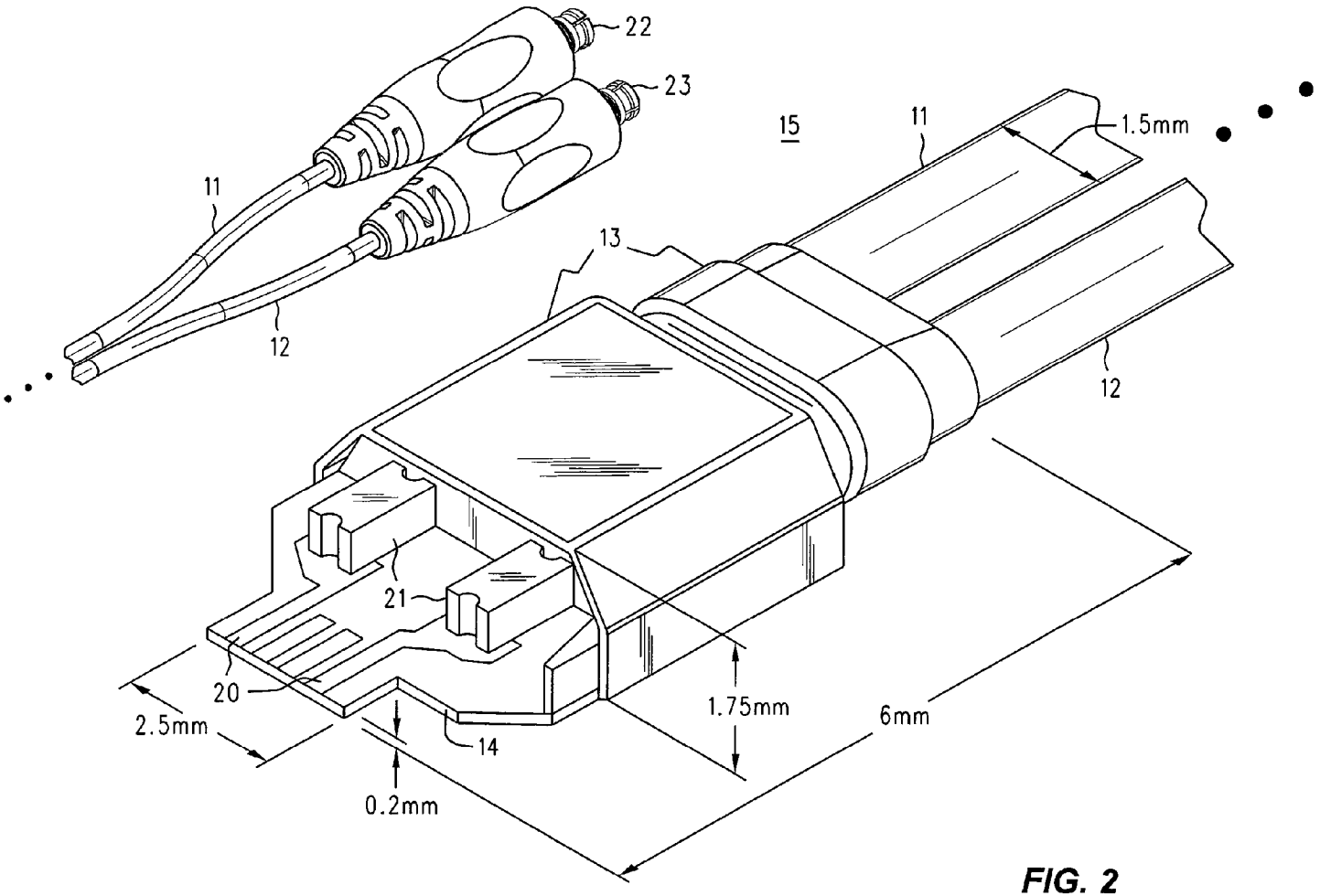
FIG. 2 is an enlarged perspective view of the ZIF browser of FIG. 1 and of the short flexible extended transmission lines that connect the handheld probe housing to the interconnect PCB within the ZIF browser.

What we shall call, for want of a better term, a 'ZIF browser' (15) is coupled via a pair of short flexible transmission lines (11, 12) and an associated pair of coaxial microwave connectors (see 22 and 23 of FIG. 2) to the business end of the probe housing 9 (the associated pair of connectors on the probe housing 9 are not visible in FIG. 1). A pair of strain relief boots 10 on the cable mounted connectors serve as grips for mating and unmating these connectors. The entire ZIF browser 15, then, includes the connectors 22 and 23, grips 10, transmission lines 11 and 12, a housing/strain relief 13 and an interconnect PCB 14. (PCB 14 is best seen in FIG. 2, and carries some additional electrical parts of its own related to the electrical architecture of the active probe. U.S. Pat. Nos. 6,483,284 B1 (Eskeldson, et al.) and 4,473,839 (Rush) offer a description of what that architecture is.)

A ZIF browser 15 is intended to be mated with a ZIF connection accessory 16 that includes a ZIF connector 17 and flying leads 19 the are connected to a signal of interest within some system or device 18 being tested or analyzed. The connections to the DUT or SUT by the flying leads 19 may be made with soldering. Owing to the narrow width of traces on modem high density PCBs, such solder joints are apt to be fragile, and even a mild tug on lead 19 can break them. Because a ZIF connector is used, the browser 15 is easily mated and unmated from the connection accessory without the application of awkward amounts of force that might accidently be applied to either the probe housing 9 or the solder joints for flying leads 19 (or to a component that leads 19 might be soldered to instead of to a trace).

As further insurance in this department (gorilla proofing), it is often possible to select a ZIF connector 17 whose latching mechanism will give way and release the ZIF browser before the solder joints for the flying leads 19 are broken. As an alternative, the ZIF connector might not have a genuine latch and simply relies upon gripping force applied by the female contacts to the male lands to retain the ZIF browser, but again not so tightly so as to not yield to a tug not strong enough to break the solder joints. The OMRON XF2U part mentioned below fits into this latter category.

For brevity and clarity in the exemplary illustration of FIG. 1 we have shown only one handheld probe housing 3 and its ZIF browser 15. It will, of course, be appreciated that there may be a plurality of active probes in use, each being equipped with a separate ZIF browser 15. Furthermore, and as is shown, there may be several ZIF connection accessories (16) in use at one time, whether there is just one ZIF browser in use, or several ZIF browsers in use. In addition, it will be appreciated that the ZIF browser/connection accessory combination (15/16) is not one of individually paired items; that is, they are not 'matched' to each other as to their individual physical or electrical tolerances, and any ZIF browser 15 will mate with any ZIF connection accessory 16. (That is, will mate with one of any style that it is 'supposed to' mate with, meaning that the number of contacts and what manufacturer's ZIF connector is in use are correct for the probe and ZIF browser at hand . . . ). To help avoid confusion in a setting where many ZIF browsers and their connection accessories are in use, the customary colored snap-on clips or colored rubber O-rings can be used to identify 'scope channels and to differentiate between the various signals.

And upon reflection, it will also be appreciated that, just as there are 'cross-series' adaptors for RF connectors (e.g., APC-3.5 to N) there can be ZIF browsers whose connectors (22, 23) or whose interconnect PCB (14 of FIG. 2) is altered to mate or otherwise comport with the particular style chosen by another manufacturer of a comparable item, or by the same manufacturer but for a different series of products.

Refer now to FIG. 2, wherein is shown an enlarged perspective view of the ZIF browser 15. Shown in the figure are the extended transmission lines (which may be small diameter 50Ω coaxial cables) 11 and 12, the housing and strain relief 13 that assists in keeping the signal conductors of the extended transmission lines electrically connected to associated trace on the interface PCB 14, and transmission lines 11 and 12 mechanically connected to the browser as a whole. We also see connection lands 20. Although the figure shows four such lands, that is merely illustrative, as the particular number and nature of those conductors will depend on whether the probe 3/9 is single-ended of differential, or where in the case of a logic analyzer application, there might be a great many such lands 20 (and 11/12 would then be increased in number to match the number of channels being measured, and either coax or ribbon cable might be used as the transmission line). So, for example, there might be a ground plane (not shown) on the under side of interconnect PCB 14 and the lands 20 are part of a strip transmission line arrangement, or those lands might belong to a co-planar transmission line, and so on. In the particular example shown we only need two conductors, and choose the outermost locations, and replicate them on the underside (or, alternatively, the ZIF connector can have top and bottom contacts that are connected together). In this particular example, the interconnect PCB 14 and the ZIF connector with which it mates do not as a combination enforce keying, although that feature could be arranged if desired. The particular arrangement shown and described here allows the ZIF browser to be 'turned over' and still inserted and retained. The worst that happens then is that the differential signal is displayed as inverted, which is a minor matter to correct with the 'scope's display controls.

Figure 3:
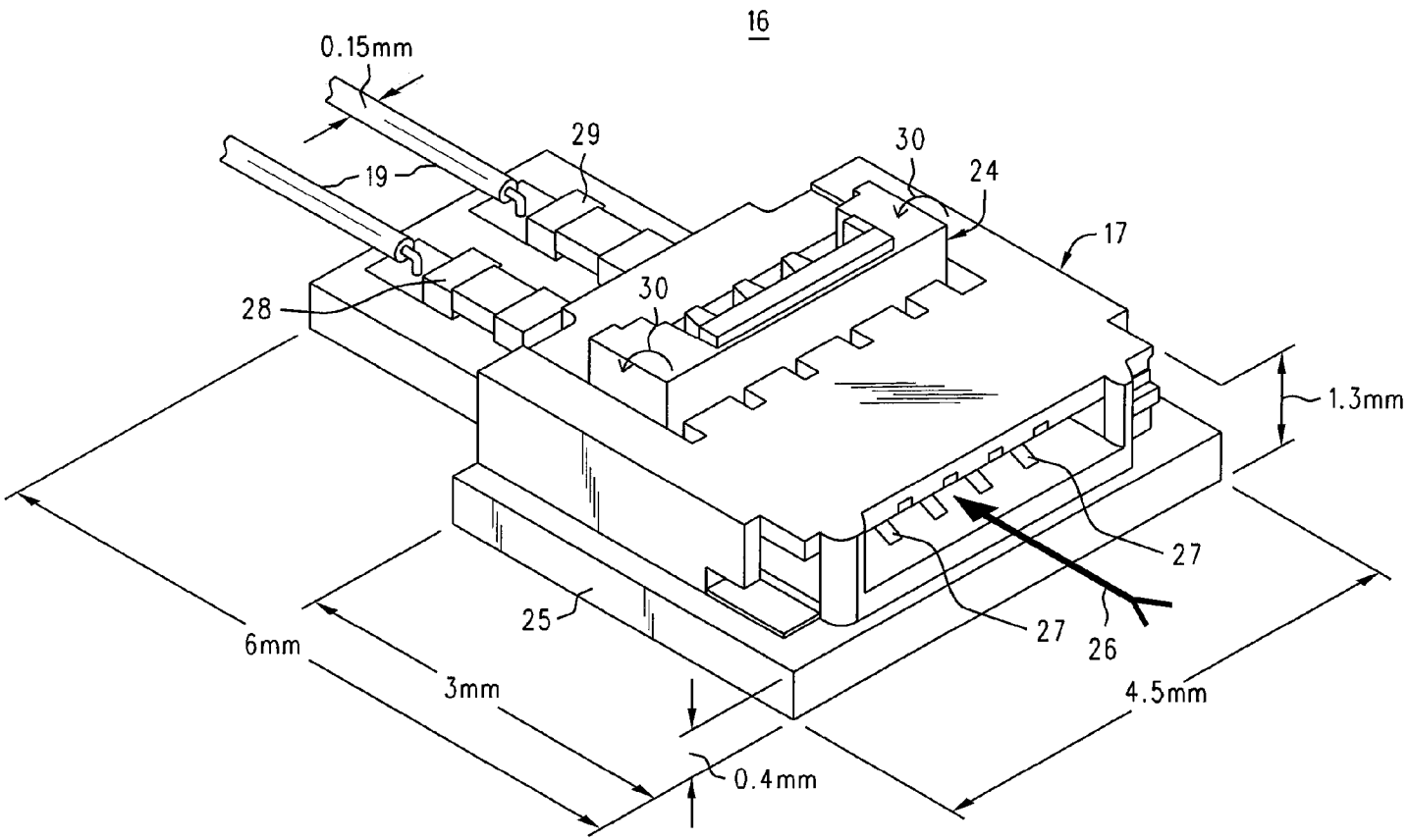
FIG. 3 is an enlarged perspective view of the ZIF connection accessory of FIG. 1 and its flying leads that may be soldered to signals of interest, and whose ZIF connector mates with the interconnect PCB of FIG. 2.
Figure 4:
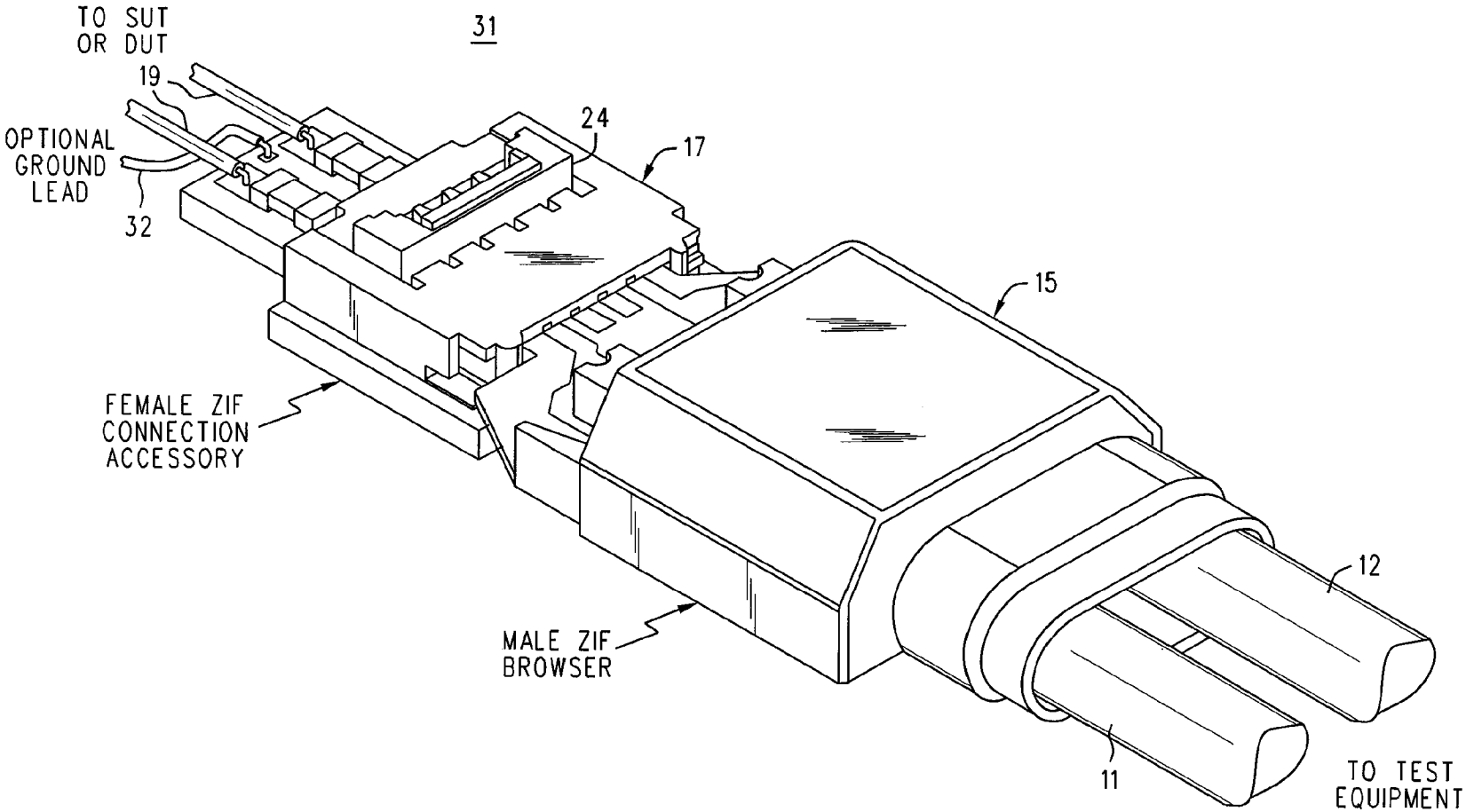
FIG. 4 is an enlarged perspective view of the ZIF connection accessory of FIG. 3 mated with the ZIF browser of FIG. 2.

Depending upon the nature of the ZIF connector in use, there may also be some mechanical structure within the ZIF browser to cooperate with the ZIF connector proper, to establish keying (fits together only one way) and latching (won't come apart readily unless the latch is released). These aspects of the ZIF connector will follow from which ever connector is chosen for use. FIGS. 2, 3 and 4 do not show such structure, although it will be appreciated that such mechanisms are known in the connector arts.

We do wish to point out, however, that the lands 20 [and any ground plane on the underside, if such there be, that also encounters contact fingers in the mating (female) portion of the connector (17 of FIG. 3)] are given a generous thickness of plating with a noble metal, e.g., fifty micro-inches of gold over a nickle plated etched copper foil laminated to an FR4 substrate. Such gold plating is done, not just to obtain a surface whose oxide is conductive, but also to ensure that the surface remains serviceable for a suitable length of time, say, at least 1,500 insertion cycles.

Before leaving FIG. 2 take note of components 21. There are two of these in the particular example shown for a differential probe, one for each side of the differential pair. They are each a thick film RC (Resistor-Capacitor) surface mounted network made up of, say, 25 KΩ shunted by a small value of capacitance. These parallel RC combinations are what establish the basic loading (probe's input impedance) that the probed circuit (often a 50Ω location) experiences (neglecting strays and parasitics associated with the flying leads 19). See the aforementioned U.S. Pat. Nos. 6,483,284 B1 (Eskeldson, et al.) and 4,473,839 (Rush). In other applications having a different electrical architecture these isolation components 21 might be absent.

Before leaving FIG. 2, we wish to point out that, for application with a high frequency active probe anyway, the ZIF browser 15 is pretty small. One actual ZIF browser for use up to about twenty Gigahertz with a differential probe is about 6 mm long and 1.75 mm high, with a diameter of 1.5 mm for the 50Ω transmission lines 11 and 12, whose length might be in the range of about 60 mm to 120 mm. The interconnect PCB 14 is of 0.2 mm thick FR4, and the width of the region where the lands penetrate the ZIF connector is 2.5 mm wide.

Refer now to FIG. 3, which is an enlarged perspective view of the ZIF connection accessory 16. It includes a ZIF connector 17 that is mounted to a small circuit board 25 which has conductors (traces) that connect to the contacts 27 in the connector 17 at one end and to isolation components 28 and 29 at the other. Preferably, the underside of circuit board 25 is free of any conductive material, the better to lessen any worries about what it might touch during use. Typically, there will be one isolation component per single ended channel, and two per differential channel. The flying leads 19 are connected to the other end of the isolation components 28 and 29, which may be low valued surface mount resistors in series with the signal for damping, or might be series capacitors in an application where AC coupling was required. We can imagine that there might be an application somewhere that does not need these isolation components 28 and 29, in which case they would be absent. The flying leads are small, and may be short (e.g. of diameter 0.15 mm and of length perhaps somewhere in the range of 40 mm to 80 mm). They are also very flexible.

The interconnect PCB 14 of the ZIF browser 15 enters the connector 17 at the location, and in the direction shown, by arrow 26. As before, the particulars of the ZIF connector 17 proper (keyed entrance, latching and unlatching) will stem from which manufacturer's product is used. The parts 17 in FIGS. 3 and 22 in FIG. 2 are consistent with the use of a member of the XF2U family of parts from the OMRON Corporation of Japan.

As mentioned above, that particular ZIF connector is neither keyed nor latched. It relies strictly upon gripping force to retain the connection. In this connection (we can't resist the pun!) note item 24. It is a bar-shaped lever or actuator that can be engaged between a thumb and opposing finger and then rotated in the direction of arrows 30. (The axis of rotation is within the innards of the ZIF connector 17, and is not visible.) What this does for this particular connector is engage four cams, one for each contact position of the connector. The engagement of the cams removes the insertion force by moving opposing contact elements away from each other. Once the ZIF browser 15 has been inserted, thing 24 is rotated back to its original position, and gripping force is applied.

Finally, once again note that the ZIF connection accessory 16 is small (6 mm long by 4.5 mm wide by 1.3 mm high.

It will be noticed that the particular embodiment that has been described does not include a ground lead. This certainly does not mean that provision cannot be made for one if that is desirable. In some previous browser applications the good AC ground of the transmission lines 11 and 12 is brought as far forward as possible, after which it might or might not be available as a separate ground lead.

Finally, refer to FIG. 4, wherein is shown an enlarged perspective view 31 of a portion of a ZIF browser 15 fully mated with a ZIF connection accessory 16. Note that it shows an optional flying ground lead 32.

I claim:

1. Apparatus for connecting an electronic probe to a workpiece having a signal of interest that is to be measured, the apparatus comprising:

an interconnect circuit board having a plurality of lands along a mating edge and a respective plurality of traces connected thereto and leading toward a second edge;

at least one flexible transmission line having a coaxial connector at one end for connection to a corresponding coaxial connector upon the electronic probe, and attached at the other end to a signal trace and to a ground trace each within the plurality of traces leading toward the second edge of the interconnect circuit board;

a carrier circuit board;

a zero insertion force connector mounted upon the carrier circuit board and in such a manner that the plurality of lands along the mating edge of the interconnect circuit board can enter the zero insertion force connector and the interconnect circuit board mate with the zero insertion force connector;

at least one flexible signal conductor, connected at one end to a corresponding signal trace on the carrier circuit board that leads from the zero insertion force connector toward a third edge of the carrier circuit board, and for connection at the other end to a signal of interest; and at least one flexible ground conductor, connected at one end to a corresponding ground trace on the carrier circuit board that leads from the zero insertion force connector toward the third edge of the carrier circuit board, and for connection at the other end to a signal ground within the workpiece.

2. Apparatus as in claim 1 further comprising at least one isolation component on the carrier circuit board and in series with a respective one of the at least one flexible signal conductor.

3. Apparatus as in claim 2 wherein the isolation component comprises a damping resistor.

4. Apparatus as in claim 2 wherein the isolation component comprises a capacitor.

5. Apparatus as in claim 1 further comprising an isolation component in series with at least one of the plurality of traces on the interconnect circuit board.

6. Apparatus as in claim 5 wherein the isolation component comprises a parallel RC network that sets the input impedance of the electronic probe.

7. Apparatus as in claim 1 wherein the electronic probe comprises an active probe.

8. Apparatus as in claim 7 wherein the active probe is for an oscilloscope.

9. Apparatus for connecting an electronic probe to a workpiece having signals of interest that are to be measured, the apparatus comprising:

an interconnect circuit board having a plurality of lands along a mating edge and a respective plurality of traces connected thereto and leading toward a second edge;

a plurality of flexible transmission lines each having a coaxial connector at one end for connection to a corresponding coaxial connector upon the electronic probe, and each attached at the other end to a respective signal trace and to a respective ground trace each within the plurality of traces leading toward the second edge of the interconnect circuit board;

a carrier circuit board;

a zero insertion force connector mounted upon the carrier circuit board and in such a manner that the plurality of lands along the mating edge of the interconnect circuit board can enter the zero insertion force connector and the interconnect circuit board mate with the zero insertion force connector; and a respective flexible signal conductor for each flexible transmission line, each respective flexible signal conductor connected at one end to a corresponding signal trace on the carrier circuit board that leads from the zero insertion force connector toward a third edge of the carrier circuit board, and each flexible signal conductor for connection at the other end to a respective signal of interest.

10. Apparatus as in claim 9 further comprising at least one flexible ground conductor, connected at one end to a corresponding ground trace on the carrier circuit board that leads from the zero insertion force connector toward the third edge, and for connection at the other end to a signal ground within the workpiece.

11. Apparatus as in claim 9 further comprising at least one isolation component on the carrier circuit board and in series with a respective one of the at least one flexible signal conductor.

12. Apparatus as in claim 11 wherein the isolation component comprises a damping resistor.

13. Apparatus as in claim 11 wherein the isolation component comprises a capacitor.

14. Apparatus as in claim 9 further comprising an isolation component in series with at least one of the plurality of traces on the interconnect circuit board.

15. Apparatus as in claim 14 wherein the isolation component comprises a parallel RC network that sets the input impedance of the electronic probe.

16. Apparatus as in claim 9 wherein the electronic probe comprises an active probe.

17. Apparatus as in claim 16 wherein the active probe is for an oscilloscope.

* * * * *